US005411438A

United States Patent [19]

White et al.

[11] Patent Number: 5,411,438

[45] Date of Patent: May 2, 1995

[54] HEATING, VENTILATING AND AIR-CONDITIONING SYSTEMS

[75] Inventors: David White, Selsey; Colin Sawyer, Maldstone; Pater Bartingale, Margate, all of England

[73] Assignee: Hunter Technical Developments Limited, Jersey, Channel Islands

[21] Appl. No.: 35,385

[22] Filed: Mar. 22, 1993

[30] Foreign Application Priority Data

Dec. 3, 1992 [GB] United Kingdom ..... 9225345

[51] Int. Cl.[6] ..... F24F 13/062

[52] U.S. Cl. ..... 454/300; 137/601; 138/39; 251/297; 403/364; 411/509; 411/970; 411/999; 454/292; 454/326

[58] Field of Search ..... 454/299, 300, 309, 310, 454/311, 312, 326, 336, 292; 138/39; 137/601; 251/212, 297; 403/364, 355; 411/970, 999, 508, 509, 510, 411

[56] References Cited

U.S. PATENT DOCUMENTS

| | | | |
|---|---|---|---|
| 2,735,352 | 2/1956 | Demuth | 454/310 |
| 2,928,331 | 3/1960 | Averill | 454/300 |
| 3,107,597 | 10/1963 | Person | 454/300 |
| 3,196,895 | 7/1965 | Dayus | 137/601 X |
| 3,495,521 | 2/1970 | Foster | 137/601 |
| 3,812,772 | 5/1974 | Kaiser . | |
| 3,836,217 | 9/1974 | Shiina | 403/364 X |
| 4,501,193 | 2/1985 | Trigourea . | |
| 4,513,655 | 4/1985 | Dayus | 454/326 X |
| 4,665,806 | 5/1987 | Martin, Sr. . | |

FOREIGN PATENT DOCUMENTS

| | | | |
|---|---|---|---|
| 0056625 | 7/1982 | European Pat. Off. . | |
| 387935 | 1/1924 | Germany | 138/39 |
| 0509287 | 7/1939 | United Kingdom . | |
| 0747864 | 4/1956 | United Kingdom . | |
| 0939645 | 10/1963 | United Kingdom . | |
| 0994115 | 6/1965 | United Kingdom . | |
| 1395646 | 5/1975 | United Kingdom . | |
| 1395890 | 5/1975 | United Kingdom . | |
| 1412269 | 10/1975 | United Kingdom . | |
| 1444806 | 8/1976 | United Kingdom . | |
| 1516767 | 7/1978 | United Kingdom . | |
| 2021756 | 12/1979 | United Kingdom . | |
| 1594964 | 8/1981 | United Kingdom | 454/300 |
| 2081883 | 2/1982 | United Kingdom . | |
| 2204373 | 11/1988 | United Kingdom . | |

*Primary Examiner*—Harold Joyce
*Attorney, Agent, or Firm*—Webb Ziesenheim Bruening Logsdon Orkin & Hanson

[57] ABSTRACT

At an outlet of a heating, ventilating or air conditioning system air passes from the ducting through a plenum chamber, a damper provided with a set of blades which are movable between open and closed positions and a diffuser which directs the air in a desired direction. The plenum chamber is provided with internal vanes which act to guide a flow of air through the chamber between its inlet and outlet. The damper defines a plurality of predetermined blade positions between the open and closed positions and a resilient finger and teeth for retaining the blades in a selected one of said predetermined positions. The damper has a frame comprising a plurality of discrete frame elements interconnected at each corner joint of the frame by a friction fit pin passing through interdigitated projections on the frame elements. The diffuser is formed as a plurality of concentric portions which are each integrally formed with cooperating snap-fitting connections enabling the portions to be interconnected to form a complete diffuser. The blades for the damper have an integrally moulded body and a separate blade spindle received within a bore formed in the moulded body. The diffuser is mounted on a support connected to the plenum chamber by way of a fastening comprising an integrally formed head and shank which is threaded adjacent its free end, together with integrally formed resilient fingers for retaining the fastening in position on part of the diffuser whilst permitting rotation of the fastening.

38 Claims, 6 Drawing Sheets

HEATING, VENTILATING AND AIR-CONDITIONING SYSTEMS

BACKGROUND OF THE INVENTION

The present invention relates broadly to the area of heating, ventilating and air-conditioning systems and more particularly to the components which are located at outlets through which air is supplied to or extracted from a space to be ventilated or the like by the system. Whilst the present specification will refer to the use of components in heating, ventilating and air-conditioning systems, it is to be appreciated that certain aspects of this invention may find applications in other areas of technology.

At an outlet of a heating, ventilating or air-conditioning system the ducting through which air is supplied or extracted is usually connected to a so-called plenum chamber which may be considered as a box which acts as an air buffer. The plenum chamber may incorporate a damper having a set of blades movable between fully open and fully closed positions, the damper being used to regulate the flow of air through its associated outlet. The plenum chamber carries a diffuser which is usually mounted so as to be flush with a ceiling (most commonly a false or suspended ceiling). When air is to be supplied to a space to be ventilated it is conveyed along the ducting of the heating, ventilating or air-conditioning system and passes into the plenum chamber and then through the damper before entering the space to be ventilated via the diffuser which directs the air in a desired pattern or direction. Conventionally all of the components located at the outlet of the heating, ventilating or air-conditioning system have been formed substantially of metal.

The present invention seeks to provide an improvement on existing designs for the components discussed above.

SUMMARY OF THE INVENTION

A first aspect of this invention provides a plenum chamber for use adjacent an outlet of a heating, ventilating or air conditioning system, the chamber being defined by a peripheral wall and having an inlet, the inlet being adapted for connection to ducting of the heating, ventilating or air conditioning system so as to receive air supplied via the ducting and to direct air into the chamber, the chamber having an outlet extending in a different direction to that of the inlet, the plenum chamber incorporating a plurality of substantially planar vanes which extend inwardly from the peripheral wall of the chamber, the vanes being disposed parallel with each other on one side of the chamber and acting to guide a flow of air through the chamber between the inlet and the outlet.

This arrangement of vanes in the chamber facilitates moulding the chamber in plastics and, in particular, enables moulding to be effected using only a two part tool, thereby keeping production costs to a minimum.

Advantageously the vanes are all substantially identical in form.

Preferably each vane extends along one side of the plenum chamber from a position adjacent the inlet of the chamber, each vane terminating at a position spaced from the outlet of the chamber.

Conveniently each vane extends inwardly within the interior of the chamber from the wall thereof but does not extend fully across the chamber, each vane defining a free edge, said free edge of each vane extending in a direction parallel to the direction in which the inlet of the chamber extends at its end located closest to the inlet of the chamber and extending in a direction parallel to the direction in which the outlet of the chamber extends at its end located closest to the outlet of the chamber.

The chamber may incorporate an additional vane extending transversely with respect to each vane, said additional vane being disposed adjacent the inlet of the chamber and extending across the inlet between opposed regions thereof.

If provided, the additional vane may be removably mounted adjacent the inlet of the chamber.

A second aspect of this invention provides a damper for use adjacent an outlet of a heating, ventilating or air conditioning system, the damper comprising a frame and a plurality of blades extending between opposed parts of the frame, the blades being rotatably mounted for movement between open and closed positions in order to regulate a flow of air through the damper, the damper having a linkage arrangement, the linkage arrangement engaging and interconnecting the blades such that the blades move in synchronism with adjacent blades rotating in opposite directions as the blades move between the open and closed positions, there being an element in the linkage arrangement which is movable relative to a fixed element defined by another part of the damper, one said element constituting a set of teeth defining a plurality of predetermined blade positions between said open and closed positions and the other said element constituting a resilient finger which engages the set of teeth and retains the blades in a selected one of said predetermined positions.

Preferably said set of teeth is defined by the element in the linkage arrangement and said element constituting said resilient finger comprises part of the damper frame.

Conveniently the linkage arrangement comprises a runner component mounted in the damper for linear movement adjacent one part of the damper frame, the runner component defining a plurality of recesses and each blade defining a protection which passes into a respective recess in the runner component, the projections on adjacent blades being disposed at positions on opposite sides of the axes of rotation of the blades such that linear movement of the runner component results in rotation of adjacent blades in opposite directions.

Advantageously the inherent resilience of the finger biases the finger into the space defined between two adjacent teeth in said set of teeth but still permits relative movement between said first and second parts of the damper with the finger riding over the teeth in said set of teeth when the first and second parts of the damper are moved relative to each other.

Preferably the resilient finger has a free end which is formed with a single tooth configured to permit relative movement between said first and second parts of the damper in two opposed directions corresponding to movement of the blades towards the open position and towards the closed position with the finger riding over the teeth in said set of teeth.

A third aspect of this invention provides a frame comprising a plurality of discrete frame elements interconnected at corner joints of the frame, each frame element being formed at opposite ends with one or more projections, each corner joint of the frame comprising at least one projection on one frame element interdigitated between a plurality of projections formed on an adjacent frame element, the interdigitated projections on the frame elements at each corner joint defining substantially aligned bores, the frame elements being interconnected at each corner joint by a pin extending through the substantially aligned bores in the interdigitated projections, the pin being a friction fit within the substantially aligned bores defined by the interdigitated projections such that the interconnected frame elements at each corner joint of the frame cannot effect relative rotational movement.

Relative rotational movement of the interconnected frame elements at each corner joint may be further prevented by a projection on one of the frame elements engaging a surface of the other frame element at a position outside of the plan area of the substantially aligned bores.

Preferably the internal surface of the substantially aligned bores in the projections on the frame elements is formed with at least one region which is deformed upon insertion of the pin into the substantially aligned bores so as to produce said friction fit.

Alternatively, the pin may have an external surface which is formed with at least one region which is deformed upon insertion of the pin into the substantially aligned bores so as to produce said friction fit.

Conveniently said deformable region comprises a rib formed on the external surface of the pin.

Advantageously the pin defines a plurality of said ribs, each rib extending generally axially of the pin.

Preferably the bores defined by the projections on adjacent frame elements are initially slightly out of alignment when the projections on adjacent frame elements are interdigitated with the frame elements at a predetermined angle relative to each other, the bores being drawn into alignment upon insertion of the pin, whereupon the frame elements are securely retained at said predetermined angle relative to each other.

Conveniently the pin is tapered. The pin may define a head, the pin tapering as it extends away from the head.

This invention also provides a damper for use adjacent an outlet of a heating, ventilating or air conditioning system, the damper comprising a frame as described above and a plurality of blades extending between opposed parts of the frame, the blades being movable between open and closed positions in order to regulate a flow of air through the damper.

A fourth aspect of this invention provides a diffuser for use adjacent an outlet of a heating, ventilating or air conditioning system, the diffuser having means to communicate with a supply of air from the heating, ventilating or air conditioning system and having a plurality of blades through which air discharges into a space to be ventilated, the diffuser comprising a central portion and a peripheral frame portion which surrounds said central portion, the central portion and the frame portion being concentric and being integrally formed with cooperating snap-fitting connections enabling said portions to be interconnected to form a complete diffuser, both the central portion and the frame portion defining blades with air passages therebetween through which air is discharged, the blades of the frame portion surrounding the blades of the central portion.

The diffuser may further comprise an intermediate portion which surrounds the central portion and which is surrounded by the peripheral frame portion, the central portion, the intermediate portion and the frame portion all being concentric and being integrally formed with snap-fitting connections enabling said portions to be interconnected to form a complete diffuser.

Preferably the snap-fitting connection between the central portion and the intermediate portion is a releasable connection permitting removal of the central portion from the intermediate portion.

Conveniently the snap-fitting connection between the intermediate portion and the frame portion is a one-way connection designed such that the intermediate portion and the frame portion cannot readily be dismantled following assembly of the complete diffuser.

Advantageously the frame portion defines a removable portion, the removal of said portion producing a diffuser of reduced overall dimensions.

A fifth aspect of this invention provides a blade for use in a damper for a heating, ventilating or air conditioning system, the blade comprising an elongate integrally moulded body and a separate blade spindle received within an axially extending bore formed in the moulded body, the bore being defined by a plurality of recesses extending into the body at juxtaposed positions axially of the blade, alternate recesses extending into the body from different directions and to a depth such that the ends of the recesses communicate with each other to define the bore for the spindle.

Preferably said alternate recesses extend into the body of the blade from opposite directions.

Conveniently the blade body is integrally moulded from a plastics material and the spindle comprises a metal rod.

This invention also provides a damper for use adjacent an outlet of a heating, ventilating or air conditioning system, the damper comprising a frame and a plurality of blades as described above, the blades extending between opposed parts of the frame and being movable between open and closed positions in order to regulate a flow of air through the damper.

This invention further provides a damper for use adjacent an outlet of a heating, ventilating or air conditioning system, the damper comprising a frame as described above and a plurality of blades as described above, the blades extending between opposed parts of the frame and being movable between open and closed positions in order to regulate a flow of air through the damper.

A sixth aspect of this invention provides a fastening for use in removably connecting a diffuser to a support adjacent an outlet of a heating, ventilating or air conditioning system, the fastening comprising a head and a shank formed integrally with the head, the shank being formed with a screw thread at least adjacent its free end, the fastening being formed integrally with resilient means for retaining the fastening in position on part of the diffuser whilst permitting rotation of the fastening to enable the threaded part of the shank to be engaged with and removed from a bore formed in part of the support.

Preferably the resilient means for retaining the fastening in position on part of the diffuser comprise resilient fingers extending from the head of the fastening.

Most preferably the resilient fingers extend from the head of the fastening on opposite sides of the shank, the fingers extending substantially parallel to the axis of the shank and being formed with outwardly directed projections designed to engage part of the diffuser through which the fastening is passed in order to retain the fastening on the diffuser.

Preferably the shank is threaded adjacent its free end only, there being an unthreaded portion of the shank extending between the head of the fastening and the threaded portion of the shank.

Conveniently the length of the resilient fingers is substantially equal to or less than the length of the unthreaded portion of the shank.

BRIEF DESCRIPTION OF THE DRAWINGS

In order that the present invention may be more readily understood and so that further features thereof may be appreciated, the invention will now be described by way of example, with reference to the accompanying drawings in which.

DESCRIPTION OF PREFERRED EMBODIMENTS

Figure 1:
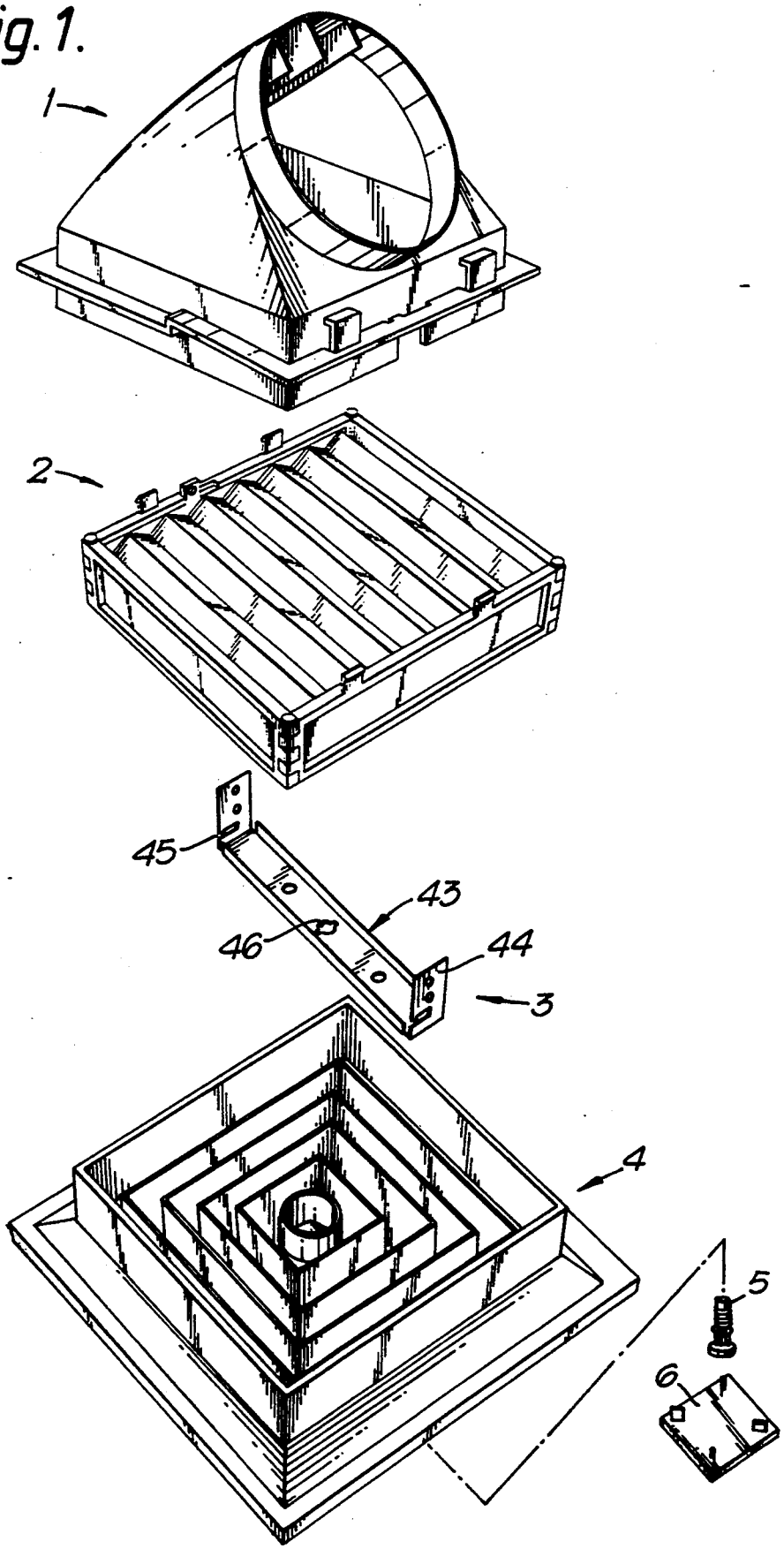
FIG. 1 is an exploded perspective view showing the main components located adjacent an outlet of a heating, ventilating or air-conditioning system.

FIG. 1 of the accompanying drawings illustrates the components located at an outlet of a heating, ventilating or air conditioning system, these components comprising a plenum chamber 1, a damper 2 designed to be received within the plenum chamber 1, a support bar 3 which is connectable to the plenum chamber and from which a diffuser 4 is suspended by way of a screw or bolt 5. A decorative cover 6 is also illustrated which conceals the mounting screw 5 when it is positioned upon the diffuser 4.

With the exception of the diffuser support bar 3 all of the components illustrated in FIG. 1 of the drawings are formed as plastics mouldings.

Figure 2:
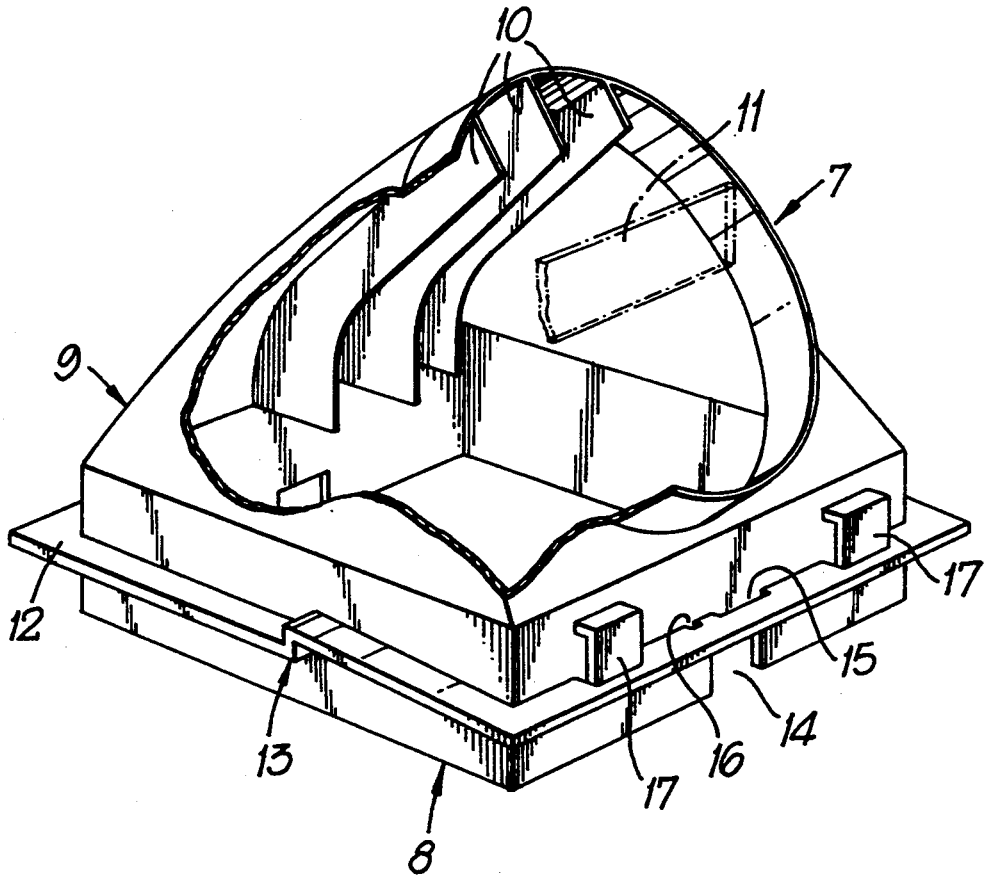
FIG. 2 is a partly cut away perspective view of a plenum chamber.
Figure 3:
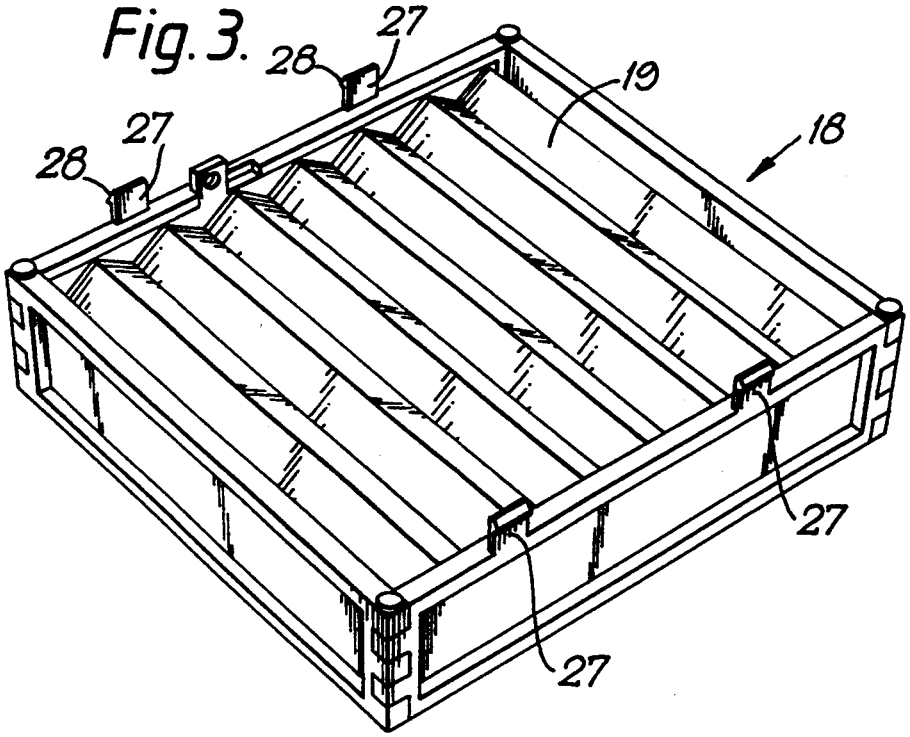
FIG. 3 is a perspective view of a damper.

Looking at the various components in more detail, the plenum chamber 1 is illustrated on an enlarged scale in FIG. 2 of the drawings and comprises a circular inlet section 7 and a rectangular or square outlet section 8. The chamber is defined by a main body 9 which constitutes a transition piece between the circular inlet and the rectangular outlet. The circular inlet 7 is designed to be connected to circular section ducting through which air is supplied. The inlet may be connected to the ducting by any appropriate means. The main body 9 defines a gradual transition between the circular inlet and the rectangular outlet which are directed in different directions. When the plenum chamber is mounted in position at an outlet of a heating, ventilating or air conditioning system the rectangular outlet 8 is directed vertically downwardly whilst the circular inlet 7 is directed upwardly at an angle of approximately 45° to the vertical. This configuration of plenum chamber is conventional and in many cases is dictated by the limited space which is available in the region where the chamber is to be installed.

Air entering the plenum chamber via the inlet 7 must be turned through an angle of approximately 45° before it passes out through the outlet 8. It is quite common for the plenum chamber inlet 7 to be connected to 'spiral ducting' which results in a rotatory movement being imparted to the air as the air moves in a generally axial direction along the ducting. This rotary movement or swirl reduces the flow rate and causes generally uneven flow conditions. In other words the flow may be considered to be turbulent as it enters the plenum chamber.

The interior of the plenum chamber 1 is provided with three parallel guide vanes 10 which are disposed on what can be considered as the interior of the rear wall of the main body 9, the guide vanes 10 extending from the entrance to the inlet portion 7 to the junction between the main body 9 and the rectangular outlet 8. The vanes do not extend down over the interior of the outlet section 8. The vanes 10 are all of substantially identical form, comprising relatively thin planar elements which extend inwardly within the interior of the chamber. At the inlet section of the plenum the end of the central vane 10 lies on a diameter extending across the circular inlet section from the uppermost point thereof. As mentioned above the two outer vanes are parallel to the central vane, all three vanes only extending inwardly over a small distance across the inlet section 7. The inwardly directed free edge of each vane 10 extends substantially parallel with the rear wall of the main body 9, initially extending at an angle of approximately 45° to the vertical (when considered in the installed position) before turning so as to extend vertically downwardly and finally turning through 90° in order to extend horizontally back to the interior of the rear wall of the main body 9.

The guide vanes 10 help to reduce swirl or rotary movement of air entering the chamber and guide the flow around the 45° turn between the inlet section and the outlet section. The vanes assist in generally reducing turbulence and, to some extent, noise generated as a result of the turbulence of the air flow. The vanes also provide an improvement in the rate of air flow through the chamber. The guide vanes 10 help generally to provide for a more even flow at the outlet of the chamber, that is to say flow conditions are more uniform across the area of the outlet.

It is envisaged that a further guide vane 11 may optionally be provided, the further guide vane 11 extending diametrically across the circular inlet section 7 and standing in a vertical plane, as illustrated by dotted lines in FIG. 2 of the drawings. The additional vane 11 would extend transversely of the vanes 10. The vane 11 may be removably mountable within the inlet section 7 by means of appropriate channels or the like formed on the interior of the circular inlet section.

The exterior of the rectangular outlet section 8 of the plenum chamber defines an outwardly directed rim or flange 12 which extends completely around the outlet section at a position approximately half way down the depth of the outlet section. As can be seen in FIG. 2 of the drawings the flange 12 is formed with a step 13 at a position centrally along opposed sides of the outlet section 8. This is for moulding purposes. At the front and the rear of the chamber the outlet section 8 is formed with centrally located rectangular recesses 14 which extend upwardly from the free lower edge of the outlet section to a position just below the flange 12. The flange 12 itself defines a rectangular slot or opening 15 at a position aligned with the top of the recess 14, the width of the slot 15 being substantially equal to the width of the recess 14. In addition a further small aperture 16 is formed to one side of the slot 15 adjacent the point where the flange 12 extends away from the wall of the outlet section 8. The recess 14, the slot 15 and the small aperture 16 are used in the mounting of the diffuser support bar 3 on the plenum chamber in a manner which will be described hereinafter. It is to be appreciated that the rear wall of the outlet section 8 of the chamber is similarly formed with a recess 14, a slot 15 and a small aperture 16.

The front and rear of the outlet section of the chamber are also formed with a pair of inverted L-shaped projections 17 which sit on top of the flange 12 at positions between the centrally located slots 15 and the corners of the outlet section, the projections 17 defining channels between their inwardly directed surfaces and the outwardly directed surface of the outlet section 8, these channels serving to receive brackets or the like (not illustrated) by way of which the plenum chamber may be suspended from drop rods in a known manner or by way which of the plenum chamber may be supported on the framework for a suspended ceiling.

The damper 2 comprises a rectangular frame 18, corresponding in size to the rectangular outlet 8 of the plenum chamber, and a plurality of elongate blades 19 which extend between opposed sides of the rectangular frame. The blades 19 are movable between open and closed positions by being rotatable about their longitudinal axes. Adjacent blades are designed to rotate in opposite directions, as will be described in further detail hereinafter.

Figure 4:
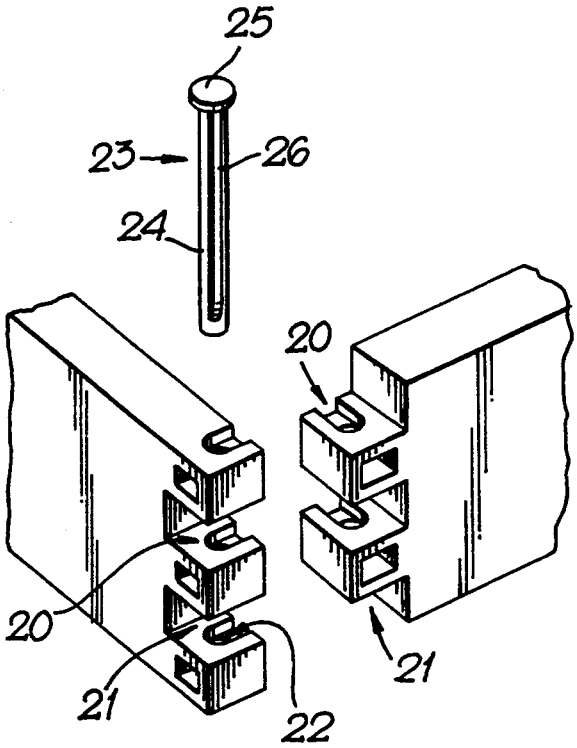
FIG. 4 is an exploded perspective view showing the components which form a corner joint of a frame for the damper of FIG. 3.

The frame 18 of the damper comprises four discrete frame elements which are interconnected at corner joints of the frame in a manner which is illustrated in FIG. 4 of the drawings.

At its opposites ends each individual frame element defines a plurality of identical projections 20 which are separated in the vertical direction (that is to say in a direction over the height of the frame as opposed to the length of the frame element) by spaces 21 which are approximately equal in depth to the depth of the projections 20. One end of each frame element is formed with two projections 20 and three spaces 21 whilst the other end of the element is formed with three projections 20 and two spaces 21. The projections at one end of the frame element are aligned with the spaces at the other end of the frame element in the vertical direction and two frame elements are designed to be interconnected at a corner joint of the frame by interdigitating the projections 20 i.e. by passing the projections 20 on one frame element into the aligned spaces 21 on the adjacent frame element.

Figure 5:
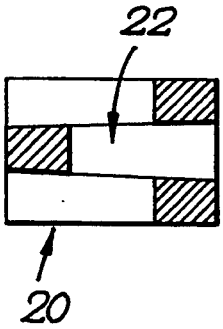
FIG. 5 is a cross-sectional view through one part of one frame component of FIG. 4.

Each projection 20 defines a vertically extending bore 22, the bores 22 in each of the projections 20 at one end of a frame element being aligned above each other. The frame elements are designed to be produced as plastics mouldings and FIG. 5 illustrates the way in which the projections 20 at the ends of each frame element are moulded so as to produce the bores 22. Each projection 20 is formed with recesses which extend horizontally into the body of the projection over approximately two thirds of its horizontal extent. Alternate recesses extend into the body of the projection from opposite sides. The recesses extend into the projection at positions vertically adjacent each other so that the end region of each recess communicates with the end region of the adjacent recess to form a single vertically extending bore 22.

Adjacent frame elements are secured at the corners of the frame by way of a pin 23 which comprises an elongate shank 24 and an enlarged head 25. The shank of the pin is formed with a plurality of axially extending outwardly projecting ribs 26. When the projections 20 on adjacent ends of the two frame elements have been interdigitated the vertically extending bores 22 in the projections on one frame element are slightly offset from the bores 22 in the projections on the other frame element, but are sufficiently aligned to define a single vertically extending bore. However, the dimension of the single bore formed by the individual bores 22 in the projections on the two frame elements is not sufficiently large to permit the pin 23 to be dropped into the aligned bores. Instead the pin 23 is designed to be an interference fit within the bore. As the pin is introduced into the bore the ribs 26 formed on the shank 24 are deformed and the bores 22 in the projections on one frame element are drawn into alignment with the bores 22 defined by the projections 20 on the other frame element. This 'pulling into alignment' of the bores 22 draws the frame elements tightly together and results in a particularly rigid corner joint.

In the present case it will be seen that the projections 20 and the spaces 21 formed at the ends of the frame elements are of substantially the same rectangular cross-section. When the projections 20 are interdigitated the projections are each received snugly within a respective space 21 with part of the outer surface of each projection 20 engaging part of the outer surface defining the space 21 within which the projection is received. Thus, even before the pin 23 is inserted into the bores 22 the arrangement of the projections 20 and spaces 21 automatically defines a right angled corner joint. Upon insertion of the pin 23 the adjacent surfaces of the projections 20 and the spaces 21 which are already in engagement are drawn more tightly together and this results in a particularly rigid right angled joint between the two frame elements. It will be appreciated that the interconnected frame elements at each corner joint cannot effect relative rotational movement. Such movement is prevented both by the friction fit of the pin 23 within the bores 22 and also by the engagement of the outer surfaces of the projections 20 with the surfaces defining the spaces 21.

All four corner joints of the frame are formed in this manner. In order to assist in inserting the pin 23 into the bores 22, the shank of the pin may be tapered slightly towards its free end. It will be appreciated that once the frame 18 has been assembled in the manner described above it is a particularly rigid construction and there is no risk of the pins 23 working themselves loose as a result of vibrations within a heating, ventilating or air conditioning system in which the damper is installed.

It should be appreciated that this type of frame construction may well find applications other than in the field of heating, ventilating and air conditioning equipment and, for example, may be used in order to form plastics moulded drawers or any other components where a particularly rigid frame construction is desired.

Two opposed elements of the frame 18 are each formed with a pair of resilient, upstanding fingers 27, each finger 27 defining an outwardly directed tooth 28 at its free, upper end. The damper is designed to be mounted within the interior of the outlet section 8 of the plenum chamber by way of the resilient fingers 27 which may be deflected inwardly as the damper is introduced into the outlet section of the plenum, with the teeth 28 springing outwardly into appropriate recesses defined in the interior of the plenum chamber when they are aligned with those recesses. The damper is positioned immediately below the level of the junction between the main body 9 and the outlet section 8 of the plenum chamber when it is installed in position within the chamber.

The frame elements and the pins 23 may be moulded in a single moulding operation with the various components being interconnected by 'sprue' material in such a way that all the components for one frame are supplied as a single interconnected kit. The components are then simply 'snapped off' the sprue material prior to assembly.

Figure 6:
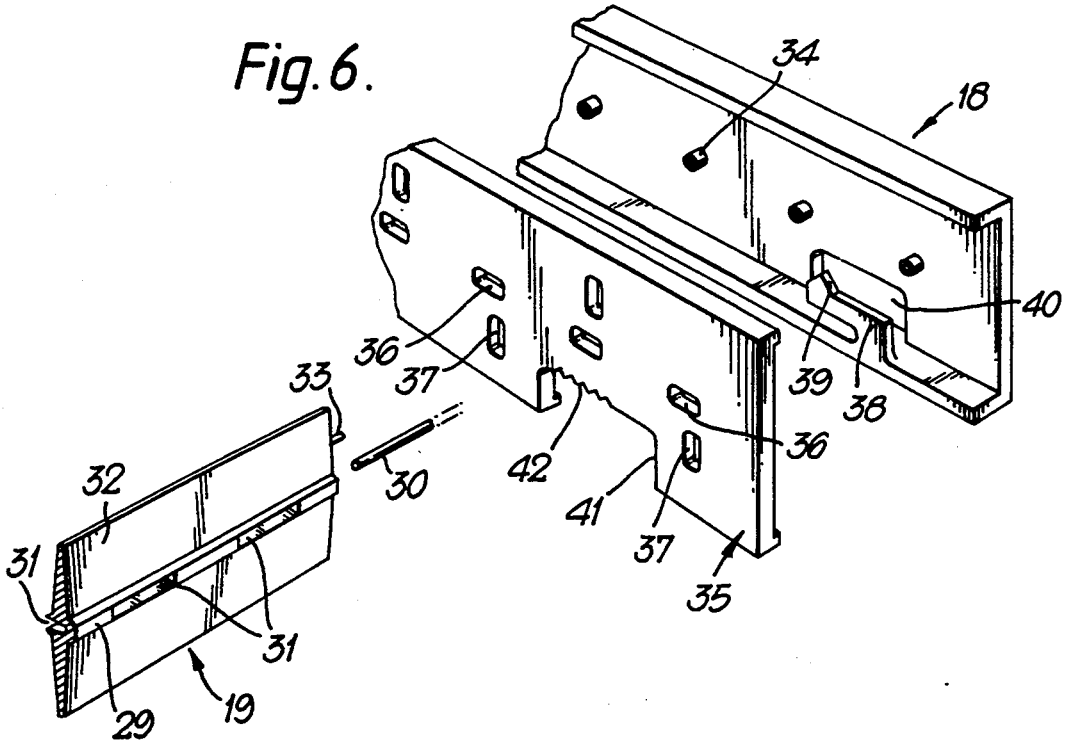
FIG. 6 is an exploded perspective view showing one end of a blade for the damper and part of an associated runner component and part of one side of the frame within which the blade is mounted.

The damper blades 19 extend transversely between the opposed frame elements which are formed with the resilient fingers 27, the blades being mounted on the opposed frame elements for rotational movement about their longitudinal axes. The blade construction is shown in FIG. 6, which includes an illustration of a sectioned part of one end of a blade. The blades are all of identical form and each comprise an injection moulded, elongate, plastics body which is substantially symmetrical about its central longitudinal axis. The body comprises a central hub region 29 defining an axially extending bore within which a metal rod 30 is received, the metal rod constituting a spindle, the opposed ends of which project beyond the ends of the blade and are mounted in the opposed frame elements of the damper. The axially extending bore within which the rod 30 is received is defined by means of rectangular recesses 31 which extend into the hub region 29 over approximately three quarters of the depth of the hub region. A plurality of recesses 31 extend into the hub region at positions spaced axially along the length of the blade. Alternate recesses extend into the hub region from opposite sides thereof at axially juxtaposed positions so that the axially adjacent edges of two opposed recesses 31 communicate with each other and a single axially extending bore is defined by the innermost region of the recesses 31. Each blade 19 is formed with two 'wings' 32 which extend radially away from the central hub region 29 in opposite directions, the wings 32 tapering towards their free edges. One end of each blade 19 is provided with a short axially extending pin 33 which extends away from the end of the blade at a position approximately half way between the central hub region 29 and the free edge of one of the wings 32.

As mentioned above the ends of the spindles 30 project beyond the ends of the blades 19 and are used in order to mount the blades within the frame 18, the opposed frame elements defining small inwardly directed, cylindrical bosses 34 through which the ends of the spindles 30 pass. The ends of the spindles may be held in place by means of a circlip or the like mounted on the outwardly directed end thereof at a position on the exterior of the frame elements. Thus, the blades are pivotally mounted within the frame 18 so as to be movable between open and closed positions.

The blades are interconnected for simultaneous movement by means of a runner component 35 which is located on the inwardly directed side of one frame element between the frame element and the ends of the blades 19. The general arrangement and location of the runner component 35 is illustrated in FIG. 6.

As can be seen from FIG. 6 of the drawings both the runner 35 and the frame elements of the frame 18 are of channel-shaped cross-section with the frame elements having the arms of their channel section directed inwardly. The runner 35 is an elongate element which is of slightly lesser overall length than the adjacent frame element and is of slightly less height than the frame element so that it may be received between the arms of the channel section of the frame element. The arms of the channel section of the runner 35 engage the base of the channel of the frame element and ensure that the bases of the respective channel sections are spaced from each other with the bosses 34 on the frame element being located within the space between the channel bases. The runner 35 is designed to be slidingly movable in a direction axially of the adjacent frame element.

The base of the channel-sectioned runner 35 defines a plurality of axially extending apertures 36 which are located approximately centrally between the arms of the channel section and at regularly spaced intervals along the length of the runner. In addition the runner defines a plurality of vertically extending elongate apertures 37 at regularly spaced intervals along the axial length of the runner. The vertical apertures 37 are spaced at intervals corresponding to the spacing of the apertures 36, with alternate apertures 37 along the runner 35 being disposed above and below the level of the axially extending apertures 36. Each aperture 37 is located adjacent one end of an aperture 36.

The axial spacing of the bosses 34 on the frame element is equal to the axial spacing of the apertures 36 and when the damper is assembled the runner 35 is received between the arms of the channel section of one frame element so that the apertures 36 are aligned with the bosses 34. One end of the spindle 30 for each blade passes through one of the apertures 36 and through the adjacent boss 34, whilst the other end of the spindle simply extends through a corresponding boss formed on the opposite frame element. The projecting pin 33 formed at one end of each blade passes into one of the vertical apertures 37.

It is to be understood therefore that adjacent blades will be arranged in the damper with their spindles 30 passing through adjacent apertures 36 on the same level and with their projecting pins 33 received in axially adjacent apertures 37 which are offset vertically on either side of the level of the apertures 36. Thus, horizontal movement of the runner 35 relative to the frame 18 will cause alternate blades to rotate in alternate directions. If one considers the blade illustrated in FIG. 6 of the drawings which has its projecting pin 33 passing into one of the upper apertures 37, horizontal movement of the runner 35 towards the left in FIG. 6 will cause anti-clockwise rotation of the blade 19 when viewed from the left hand end. An adjacent blade 19 which has its projecting pin 33 located in one of the lower apertures 37 will be caused to rotate in a clockwise direction when viewed from the left hand end when the runner 35 moves to the left in FIG. 6 of the drawings.

It will be appreciated that because the spindles 30 are fixed in position relative to the frame elements, the axial extent of each aperture 36 dictates the limit of horizontal movement of the runner 35 relative to the frame. The positioning of the apertures 36, 37 relative to each other and their axial and vertical dimensions enable the blades 19 to be moved between a position in which the blades stand vertically and may be considered to be fully open and a position in which the blades are angled relative to the vertical with the free edges of adjacent blades engaging each other in order to close the damper.

It is desirable to be able to set the damper blades to a particular position between the fully open and fully closed conditions in order to regulate the flow of air passing therethrough. Thus, in an air conditioning system there will normally be many air outlets located at differing distances from the air supply source unless the flow of air through the outlets is regulated in some way then those outlets located closest to the air supply source will tend to have a greater flow of air passing through them than the outlets which are located furthest from the air supply source. Thus, one needs to be able partially to close the outlets which are located closest to the air supply source whilst setting the outlets which are furthest from the air supply source to a more open position. With existing damper arrangements the blades may be set to a particular position, but will usually tend to move from that position with the passage of time due to vibrations within the air conditioning system, so that eventually it becomes necessary to reset all of the dampers at the outlets of the air conditioning system if the system is to work in the desired manner. This is something which is rarely undertaken and thus the air conditioning works in a far from ideal manner.

The presently proposed damper incorporates means for retaining the blades in a selected predetermined position. These means take the form of cooperating features provided on the frame 18 and the runner 35. Thus, the lower arm of the channel-sectioned frame element is formed with an upwardly directed resilient finger 38 which carries a single pointed tooth 39 at its free end, the tooth being directed towards the opposite, upper arm of the channel-sectioned frame element. The resilient finger is formed at the free edge of the lower arm of the channel-sectioned frame element at a position spaced from the base of the channel section. The base defines an aperture 40 at a position aligned with the resilient finger 38. The aperture 40 permits access to the finger from the exterior of the damper frame 18.

The runner 35 is formed with an aperture or window 41 which is somewhat larger than the aperture 40 and within which the resilient finger 38 is received when the runner 35 is mounted within the arms of the channel-section of the frame element 18. The window 41 is of rectangular form and is positioned adjacent the lower edge of the runner 35. The upper edge of the window 41 extends horizontally and defines a series of teeth 42 extending over approximately half of the axial length of the upper edge of the window. When the damper is assembled the tooth 39 formed on the resilient finger 38 engages in a space between two adjacent teeth 42 formed on the runner 35, the resilience of the finger 38 urging the tooth into the space. The teeth 42 are formed with peaks and troughs which define an angle of 90° and similarly the tooth 39 on the resilient finger 38 has a peak which defines an angle of 90°.

The engagement of the tooth 39 between adjacent teeth 42 serves normally to hold the runner in a predetermined position relative to the frame 18 and thus to hold the blades 19 at a fixed angular setting. It will therefore be appreciated that the teeth 42 effectively define a plurality of predetermined blade positions and the tooth on the resilient finger 38 constitutes means for retaining the blades in a selected one of those predetermined positions. As mentioned above the runner 35 is designed to be movable relative to the blade element in the axial direction and whilst the inherent resilience of the finger 38 will normally hold the tooth 39 in position between two adjacent teeth 42, the runner 35 may be manually moved in order to adjust the blade setting. It is envisaged that movement of the runner 35 will be effected either by directly engaging the runner with a tool which can move the runner or by pulling on a cord or cords connected to the runner and which pass over appropriate guides to a position outside of the damper. When the runner 35 is moved relative to the frame 18 the tooth 39 will ride over the teeth 42 and come to rest in a new position between two adjacent teeth 42 when the runner is once again stationary. The symmetrical configuration of the tooth 39 and the teeth 42 permits the ready movement of the runner 35 in either axial direction.

The diffuser 4 is mounted on the plenum chamber 1 by way of the support bar 3 and a securing screw 5. The support bar 3 is illustrated in FIG. 1 of the drawings and comprises an elongate channel-sectioned metal component 43 designed to extend between the front and rear walls of the outlet section 8 of the plenum chamber. The width of the channel-section of the support bar is slightly less than the width of the aperture 14 and the slot 15 which are defined in the front and the rear walls of the plenum outlet section 8 and in the flange 12. The ends of the base of the channel-section 43 are bent through 90° to form upturned end portions 44. Each end portion 44 is formed with a cut-away 45 which extends generally parallel to the base of the channel section and is configured so that the upturned end portions are of hook-like form, each having a downwardly directed projection at one vertical edge.

The base of the channel section 43 defines a centrally located circular bore 46, the edges of which are of helical or part-helical form, the circular bore 46 serving to receive the threaded securing screw 5 by way of which the diffuser is held upon the support bar.

The support bar is connected to the plenum chamber 1 by way of the hook-like end portions 44 which are designed to be passed up through the slots 15 in the flange 12 at the front and rear of the chamber with the ends of the channel section 43 passing up within the recesses 14. When the cut-away sections 45 of the end portions are aligned with the flange 12 the support bar 43 is moved laterally until the downwardly directed projections of the hook-like end portions 44 snap into the apertures 16, whereupon the support bar is retained in position upon the plenum chamber.

Figure 8:
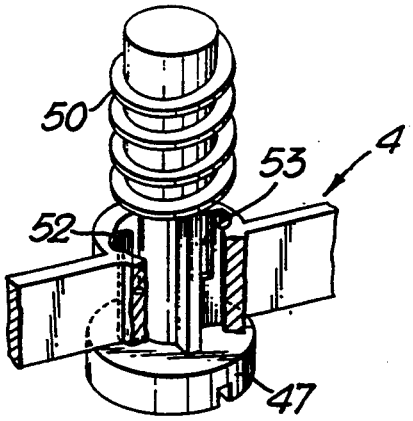
FIG. 8 is a further perspective view of the screw of FIG. 7, showing how the screw is mounted on part of the diffuser.
Figure 7:
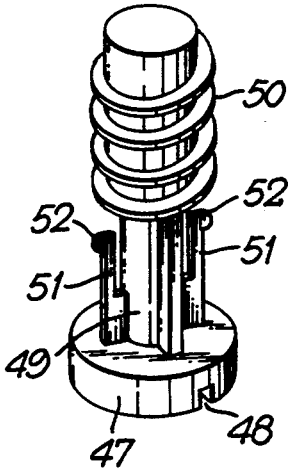
FIG. 7 is a perspective view of a screw used to mount a diffuser in position relative to the plenum chamber.

As mentioned above the diffuser is connected to the support bar 3 by means of the securing screw 5 which is designed to be held captive on part of the diffuser. The design of the screw 5 is illustrated in FIG. 7, whilst the manner in which the screw is held captive on the diffuser is shown in FIG. 8. The screw is an integrally formed plastics component having a head 47 defining a conventional slot 48. The screw has a shank comprising a first portion 49 which is of cruciform shape and which extends into a second portion 50 which is externally threaded with a large thread to facilitate the easy insertion of the threaded free end of the shank into the central bore 46 in the support bar. A pair of resilient fingers 51 extend axially from the underside of the head 47 at positions on opposite sides of the cruciform-shaped first portion 49 of the shank, each resilient finger 51 terminating with an outwardly directed projection 52. The projections 52 project radially outwardly slightly further than the threaded portion 50 of the shank.

The securing screw 5 is located on the diffuser by initially passing the threaded portion 50 of the shank through a centrally located bore 53 in part of the diffuser and then urging the resilient fingers 51 radially inwardly so that the projections 52 may also pass through the bore 53. When the projections 52 emerge from the bore 53 they naturally spring radially outwardly and are held captive behind an edge of that part of the diffuser which defines the bore 53, with the cruciform-shaped portion 49 of the shank located within the bore 53 and the head 47 engaging the surface of that part of the diffuser through which the bore 53 extends. The screw 5 is now held in position on the diffuser but may be rotated about its axis in order to enable the threaded portion 50 of the shank to be connected to the circular bore 46 formed in the support bar and thereby to hold the diffuser 4 in position adjacent the outlet section 8 of the plenum chamber. The threaded portion 50 of the shank is particularly course in order to enable the screw to be inserted into the bore 46 in the support bar 3 with the minimum number of turns. This facilitates the quick and easy installation of the diffuser 4. It will be appreciated that if the securing screw 5 were not held captive on the diffuser it would be a very awkward task for one or even two people to hold the diffuser in position whilst attempting to pass the screw 5 through part of the diffuser and into the support bar. The present design makes the task much simpler and quicker.

The diffuser 4 is formed as a plurality of interconnected concentric components. The diffuser is formed with a plurality of blades 53 in a similar manner to a known diffuser, the blades 53 serving to direct air in a desired direction as it enters a room or space to be ventilated. However, the blades 53 are formed on a plurality of discrete diffuser portions which may be interconnected by means of snap-fitting connections in order to produce the complete diffuser. Thus, the diffuser will comprise a central portion 54 which defines a bore 55 through which the securing screw 5 is passed in order to mount the diffuser on the support bar 3. The central portion defines a number of blades 53. The peripheral region of the central portion 54 is formed with resilient, outwardly directed teeth 56 which are designed to form a snap-fitting connection with apertures formed in the inner periphery of a concentric, intermediate portion 57. The intermediate portion 57 again defines a number of blades 53 and its outer periphery is similarly formed with resilient, outwardly projecting teeth 58 on part of its periphery, the teeth 58 being designed to form a snap-fitting connection with apertures formed in the inner periphery of a concentric frame portion 59. The frame portion 59 also defines some of the blades 53.

When the diffuser is assembled the central portion 54, which is square, is simply pushed into the centre of the intermediate portion which then surrounds the central portion. The assembled central and intermediate portions are then simply pushed into the frame portion which then surrounds the intermediate portion.

The outermost part of the frame portion 59 comprises a flange 60. The flange 60 is formed with a continuous groove or small channel 61 which defines a break line extending completely around the flange 60. The overall dimensions of the frame portion 59, and thus the diffuser itself, may be varied by removing the outermost portion of the flange 60 by breaking off the outermost portion outside of the channel 61. Thus, the same frame portion may be used to produce diffusers having two different overall dimensions.

The connection between the central portion 54 and the intermediate portion 57 is designed to be releasable by pressing together the opposed peripheral regions of the central portion which define the teeth 56 so that the central portion may be removed. The connection between the intermediate portion 57 and the frame portion 59 is not intended to be releasable so that once a diffuser has been assembled this connection between the two outer portions cannot be released.

Figure 9:
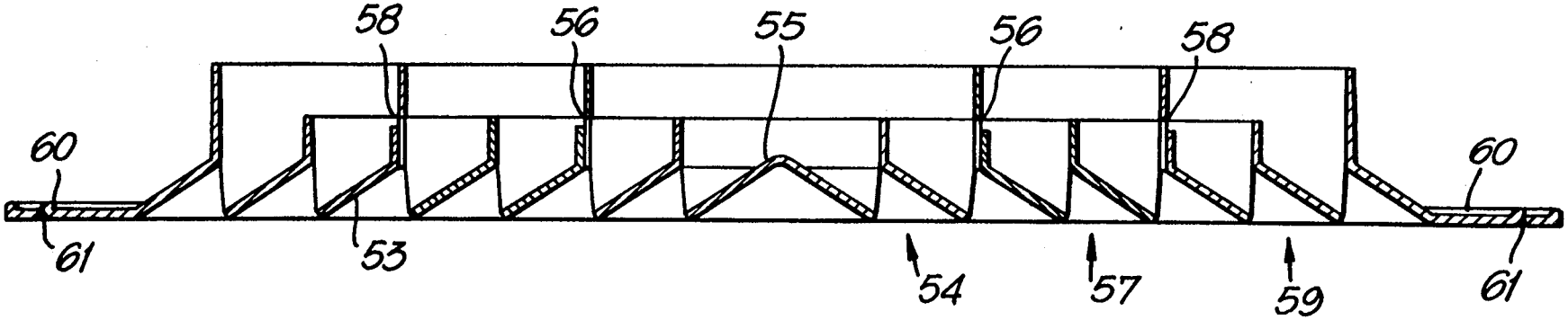
FIG. 9 is a cross-sectional view of a diffuser.
Figure 10:
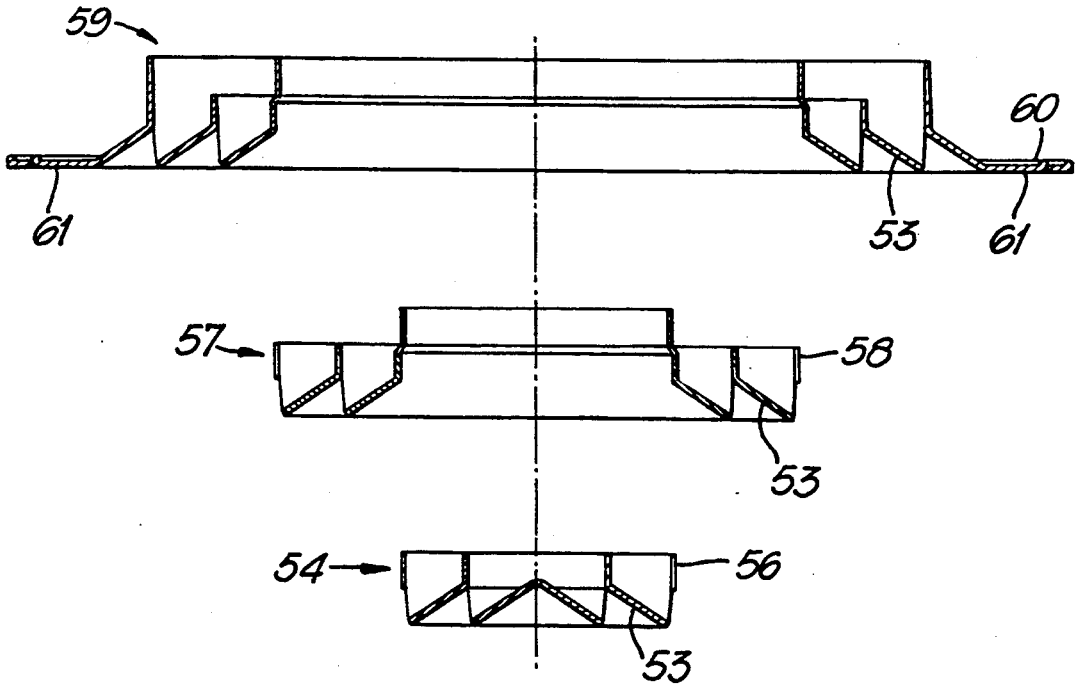
FIG. 10 is an exploded cross-sectional view of the diffuser shown in FIG. 9.

It is envisaged that a set number of diffuser portions will be produced which will enable diffusers of varying sizes to be assembled. Thus, the central portion 54 will be common to all sizes of diffuser. If a square diffuser which is 500 $mm^2$, 525 $mm^2$, 600 $mm^2$ or 625 $mm^2$ is to be produced then a common intermediate portion 57 will be connected to the central portion 54. For the 600 $mm^2$ or 625 $mm^2$ diffuser a frame portion 59 which defines some of the diffuser blades 53 will be connected to the intermediate portion. If the 625 $mm^2$ diffuser is required then the frame will be left complete. This size of diffuser is illustrated in FIGS. 9 and 10. If the 600 $mm^2$ diffuser is required then the edge region of the frame outside of the groove 61 will be removed.

Figure 11:
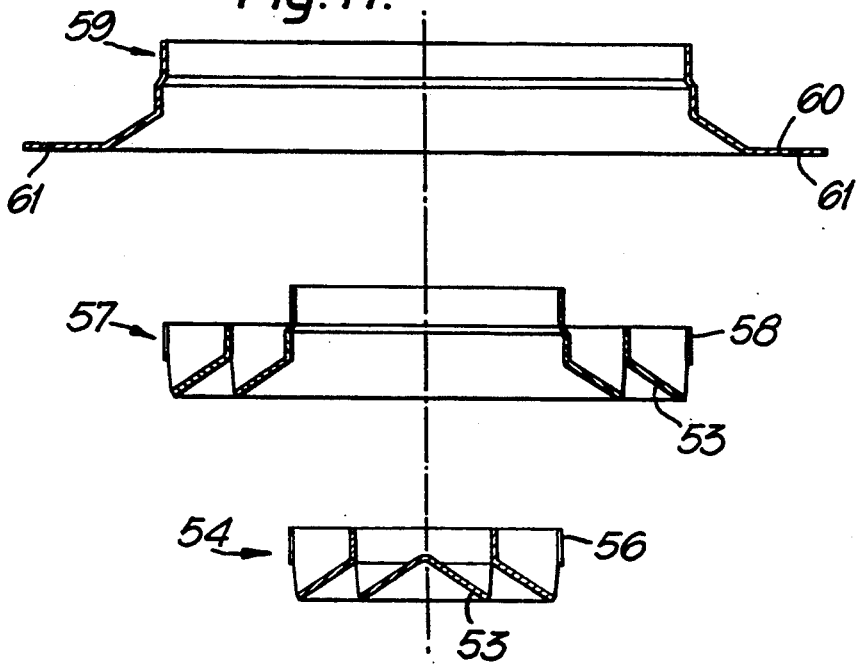
FIG. 11 is an exploded cross-sectional view of a slightly modified diffuser.

To produce a 500 $mm^2$ or 525 $mm^2$ diffuser a second design of frame portion 59 will be used, this frame portion being generally similar to the frame portion used for the 600 mm and 625 mm diffuser but not defining any blades 53 and obviously being of smaller overall dimensions. This size of diffuser is illustrated in FIG. 11. If the 500 $mm^2$ diffuser is required then the peripheral region of the frame portion will again be removed.

Figure 12:
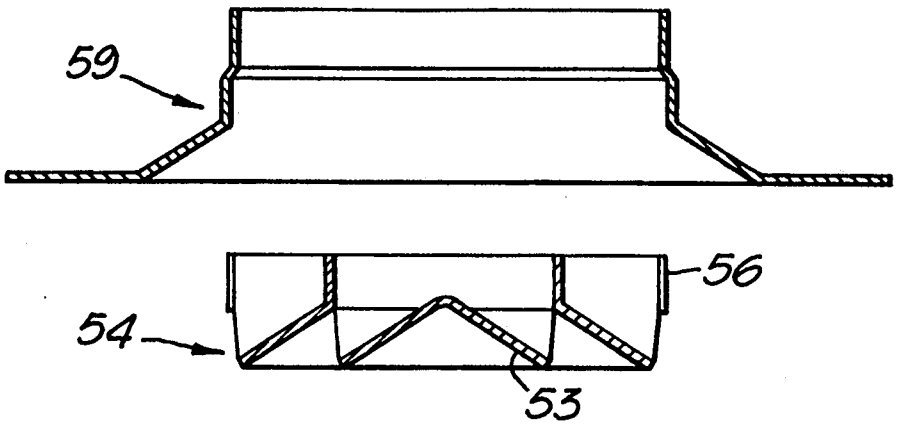
FIG. 12 is an exploded cross-sectional view of a further diffuser.

It is also proposed to use the common central portion 54 when producing an even smaller 300 $mm^2$ diffuser, as shown in FIG. 12. In this case the intermediate portion 57 will not be used and the central portion 54 will be connected to a further design of frame portion 59 which provides the desired overall dimensions. Thus, five different sizes of diffuser can be produced from a stock of components comprising a common central portion, a common intermediate portion and three different frame portions.

It is envisaged that arrangements similar to that of FIG. 12 will be used for larger diffusers. Thus a larger, two part diffuser will comprise the common central portion 54 and a larger frame portion 59 with the frame portion defining some of the blades 53 with air passages therebetween. The blades of the frame portion will surround the blades of the central portion, thereby extending the 'diffusing area' of the diffuser.

Assembly of the various portions to produce a complete diffuser is very simple and can be left to unskilled operatives working at the point of installation. Stockists need only maintain a stock of the various frames and a small number of the common central portions and the intermediate portions in order to be able to offer the full range of diffuser sizes.

The assembly of the various components at the outlet of a heating, ventilating or air conditioning system is also very simple. It will be appreciate that the plenum chamber 1 may be suspended from drop rods or supported on the frame of a false ceiling in a known manner. The damper 2 is mounted within the plenum chamber 1 by simply pushing it up into the outlet section thereof whereupon the resilient fingers 27 automatically snap into recesses or apertures defined by the plenum chamber in order to locate the damper in position. The diffuser support bar 3 is easily connected to the plenum chamber 1 by passing the upturned ends 44 through the slots 15 in the flange around the outlet section of the plenum chamber and moving them laterally so that they hook into place. The diffuser itself may then simply be connected to the support bar 3 by way of the retaining screw 5 which is held upon the diffuser and which requires only a small number of turns to locate within the bore 46 in the support bar. The decorative cover 6 may then be simply snap-fitted over a central region of the diffuser to conceal the retaining screw 5.

It is to be appreciated that various modifications may be made to the designs described above without departing from the scope of any aspect of the present invention. Whilst reference has been made to a heating, ventilating or air conditioning system supplying air to a space to be ventilated, it should be noted that such a system may also extract air from the space to be ventilated.

We claim:

1. A plenum chamber for use adjacent an outlet of a heating, ventilating or air conditioning system, the chamber being defined by a peripheral wall and having an inlet, the inlet being adapted for connection to ducting of the heating, ventilating or air conditioning system so as to receive air supplied via the ducting and to direct air into the chamber, the chamber having an outlet extending in a different direction to that of the inlet, the plenum chamber incorporating a plurality of substantially planar vanes which extend inwardly from the peripheral wall of the chamber, the vanes being disposed parallel with each other on one side of the chamber and acting to guide a flow of air through the chamber between the inlet and the outlet.

2. A plenum chamber according to claim 1 wherein the vanes are all substantially identical in form.

3. A plenum chamber according to claim 1 wherein each vane extends along one side of the plenum chamber from a position adjacent the inlet of the chamber, each vane terminating at a position spaced from the outlet of the chamber.

4. A plenum chamber according to claim 1 wherein each vane extends inwardly within the interior of the chamber from the wall thereof but does not extend fully across the chamber, each vane defining a free edge, said free edge of each vane extending in a direction parallel to the direction in which the inlet of the chamber extends at its end located closest to the inlet of the chamber and extending in a direction parallel to the direction in which the outlet of the chamber extends at its end located closest to the outlet of the chamber.

5. A plenum chamber according to claim 1 wherein the chamber incorporates an additional vane extending transversely with respect to each vane, said additional vane being disposed adjacent the inlet of the chamber and extending across the inlet between opposed regions thereof.

6. A plenum chamber according to claim 5 wherein said additional vane is removably mounted adjacent the inlet of the chamber.

7. A damper for use adjacent an outlet of a heating, ventilating or air conditioning system, the damper comprising a frame and a plurality of blades extending between opposed parts of the frame, the blades being rotatably mounted for movement between open and closed positions in order to regulate a flow of air through the damper, the damper having a linkage arrangement, the linkage arrangement engaging and interconnecting the blades such that the blades move in synchronism with adjacent blades rotating in opposite directions as the blades move between the open and closed positions, there being an element in the linkage arrangement which is movable relative to a fixed element defined by another part of the damper, one said element constituting a set of teeth defining a plurality of predetermined blade positions between said open and closed positions and the other said element constituting a resilient finger which engages the set of teeth and retains the blades in a selected one of said predetermined positions.

8. A damper according to claim 7 wherein said set of teeth is defined by the element in the linkage arrangement and said element constituting said resilient finger comprises part of the damper frame.

9. A damper according to claim 7 wherein the linkage arrangement comprises a runner component mounted in the damper for linear movement adjacent one part of the damper frame, the runner component defining a plurality of recesses and each blade defining a protection which passes into a respective recess in the runner component, the projections on adjacent blades being disposed at positions on opposite sides of the axes of rotation of the blades such that linear movement of the runner component results in rotation of adjacent blades in opposite directions.

10. A damper according to claim 7 wherein the inherent resilience of the finger biases the finger into the space defined between two adjacent teeth in said set of teeth but still permits relative movement between said linkage arrangement and said another part of the damper with the finger riding over the teeth in said set of teeth when the linkage arrangement and the other part of the damper are moved relative to each other.

11. A damper according to claim 10 wherein the resilient finger has a free end which is formed with a single tooth configured to permit relative movement between said linkage arrangement and said another part of the damper in two opposed directions corresponding to movement of the blades towards the open position and towards the closed position with the finger riding over the teeth in said set of teeth.

12. A frame comprising a plurality of discrete frame elements interconnected at corner joints of the frame, each frame element being formed at opposite ends with one or more projections, each corner joint of the frame comprising at least one projection on one frame element interdigitated between a plurality of projections formed on an adjacent frame element, the interdigitated projections on the frame elements at each corner joint defining substantially aligned bores, the frame elements being interconnected at each corner joint by a pin extending through the substantially aligned bores in the interdigitated projections, the pin being a friction fit within the substantially aligned bores, defined by the interdigitated projections such that the interconnected frame elements at each corner joint of the frame cannot effect relative rotational movement.

13. A frame according to claim 12 wherein relative rotational movement of the interconnected frame elements at each corner joint is further prevented by a projection on one of the frame elements engaging a surface of the other frame element at a position outside of the plan area of the substantially aligned bores.

14. A frame according to claim 12 wherein the internal surface of the substantially aligned bores in the projections on the frame elements is formed with at least one region which is deformed upon insertion of the pin into the substantially aligned bores so as to produce said friction fit.

15. A frame according to claim 12 wherein the pin has an external surface which is formed with at least one region which is deformed upon insertion of the pin into the substantially aligned bores so as to produce said friction fit.

16. A frame according to claim 15 wherein the or each deformable region comprises a rib formed on the external surface of the pin.

17. A frame according to claim 16 wherein the pin defines a plurality of said ribs, each rib extending generally axially of the pin.

18. A frame according to claim 12 wherein the bores defined by the projections on adjacent frame elements are initially slightly out of alignment when the projections on adjacent frame elements are interdigitated with the frame elements at a predetermined angle relative to each other, the bores being drawn into alignment upon insertion of the pin, whereupon the frame elements are securely retained at said predetermined angle relative to each other.

19. A frame according to claim 12 wherein the pin is tapered.

20. A frame according to claim 19 wherein the pin defines a head, the pin tapering as it extends away from the head.

21. A damper for use adjacent an outlet of a heating, ventilating or air conditioning system, the damper comprising a frame according to claim 12 and a plurality of blades extending between opposed parts of the frame, the blades being movable between open and closed positions in order to regulate a flow of air through the damper.

22. A diffuser for use adjacent an outlet of a heating, ventilating or air conditioning system, the diffuser having means to communicate with a supply of air from the heating, ventilating or air conditioning system and having a plurality of blades through which air discharges into a space to be ventilated, the diffuser comprising a central portion and a peripheral frame portion which surrounds said central portion, the central portion and the frame portion being concentric and being integrally formed with cooperating snap-fitting connections enabling said portions to be interconnected to form a complete diffuser, both the central portion and the frame portion defining blades with air passages therebetween through which air is discharged, the blades of the frame portion surrounding the blades of the central portion.

23. A diffuser according to claim 22 wherein the diffuser further comprises an intermediate portion which surrounds the central portion and which is surrounded by the peripheral frame portion, the central portion, the intermediate portion and the frame portion all being concentric and being integrally formed with snap-fitting connections enabling said portions to be interconnected to form a complete diffuser.

24. A diffuser according to claim 23 wherein the snap-fitting connection between the central portion and the intermediate portion is a releasable connection permitting removal of the central portion from the intermediate portion.

25. A diffuser according to claim 23 wherein the snap-fitting connection between the intermediate portion and the frame portion is a one-way connection designed such that the intermediate portion and the frame portion cannot readily be dismantled following assembly of the complete diffuser.

26. A diffuser according to claim 22 wherein the frame portion defines a removable portion, the removal of said portion producing a diffuser of reduced overall dimensions.

27. The diffuser of claim 22 further including a fastening for use in removably connecting the diffuser to a support member adjacent an outlet of a heating, ventilating or air conditioning system, the fastening comprising a head and a shank formed integrally with the head, the shank being formed with a screw thread at least adjacent its free end, the fastening being formed integrally with resilient means for retaining the fastening in position on part of the diffuser whilst permitting rotation of the fastening to enable the threaded part of the shank to be engaged with and removed from a bore formed in part of the support member.

28. A blade for use in a damper for a heating, ventilating or air conditioning system, the blade comprising an elongate integrally moulded body and a separate blade spindle received within an axially extending bore formed in the moulded body, the bore being defined by a plurality of axially spaced recesses extending into the body at juxtaposed positions axially of the blade, axially adjacent recesses extending into the body from different directions and to a depth such that the ends of the recesses communicate with each other to define the bore for the spindle.

29. A blade according to claim 28 wherein said axially adjacent recesses extend into the body of the blade from opposite side surfaces of the body.

30. A blade according to claim 28 wherein the blade body is integrally moulded from a plastics material and the spindle comprises a metal rod.

31. A damper for use adjacent an outlet of a heating, ventilating or air conditioning system, the damper comprising a frame and a plurality of blades according to claim 28, the blades extending between opposed parts of the frame and being movable between open and closed positions in order to regulate a flow of air through the damper.

32. A fastening for use in removably connecting a diffuser to a support adjacent an outlet of a heating, ventilating or air conditioning system, the fastening comprising a head and a shank formed integrally with the head, the shank being formed with a screw thread at least adjacent its free end, the fastening being formed integrally with resilient means for retaining the fastening in position on part of the diffuser whilst permitting rotation of the fastening to enable the threaded part of the shank to be engaged with and removed from a bore formed in part of the support.

33. A fastening according to claim 32 wherein the resilient means for retaining the fastening in position on part of the diffuser comprise resilient fingers extending from the head of the fastening.

34. A fastening according to claim 33 wherein the resilient fingers extend from the head of the fastening on opposite sides of the shank, the fingers extending substantially parallel to the axis of the shank and being formed with outwardly directed projections designed to engage part of the diffuser through which the fastening is passed in order to retain the fastening on the diffuser.

35. A fastening according to claim 34 wherein the shank is threaded adjacent its free end only, there being an unthreaded portion of the shank extending between the head of the fastening and the threaded portion of the shank.

36. A fastening according to claim 35 wherein the length of the resilient fingers is substantially equal to or less than the length of the unthreaded portion of the shank.

37. A damper according to claim 31 wherein the frame comprises a plurality of discrete frame elements interconnected at corner joints of the frame, each frame element being formed at opposite ends with one or more projections, each corner joint of the frame comprising at least one projection on one frame element interdigitated between a plurality of projections formed on an adjacent frame element, the interdigitated projections on the frame elements at each corner joint defining substantially aligned bores, the frame elements being interconnected at each corner joint by a pin extending through the substantially aligned bores in the interdigitated projections, the pin being a friction fit within the substantially aligned bores defined by the interdigitated projections such that the interconnected frame elements at each corner joint of the frame cannot effect relative rotational movement.

38. A heating, ventilating or air conditioning outlet system comprising:

a plenum chamber for use adjacent an outlet of the heating, ventilating or air conditioning system, the chamber being defined by a peripheral wall and having an inlet, the inlet being adapted for connection to ducting of the heating, ventilating or air conditioning system so as to receive air supplied via the ducting and to direct air into the chamber, the chamber having an outlet extending in a different direction to that of the inlet, the plenum chamber incorporating a plurality of substantially planar vanes which extend inwardly from the peripheral wall of the chamber, the vanes being disposed parallel with each other on one side of the chamber and acting to guide a flow of air through the chamber between the inlet and the outlet;

a damper received in said plenum chamber, the damper comprising a frame and a plurality of damper blades extending between opposed parts of the frame, the damper blades being rotatably mounted for movement between open and closed positions in order to regulate a flow of air through the damper, the damper having a linkage arrangement, the linkage arrangement engaging and interconnecting the damper blades such that the damper blades move in synchronism with adjacent damper blades rotating in opposite directions as the damper blades move between the open and closed positions, there being an element in the linkage arrangement which is movable relative to a fixed element defined by another part of the damper, one said element constituting a set of teeth defining a plurality of predetermined damper blade positions between said open and closed positions and the other said element constituting a resilient finger which engages the set of teeth and retains the damper blades in a selected one of said predetermined positions;

a support member connected to said plenum chamber;

a diffuser suspended from said support member, the diffuser having means to communicate with a supply of air from the heating, ventilating or air conditioning system and having a plurality of diffuser blades through which air discharges into a space to be ventilated, the diffuser comprising a central portion and a peripheral frame portion which surrounds said central portion, the central portion and the frame portion being concentric and being integrally formed with cooperating snap-fitting connections enabling said portions to be interconnected to form a complete diffuser, both the central portion and the frame portion defining diffuser blades with air passages therebetween through which air is discharged, the diffuser blades of the frame portion surrounding the diffuser blades of the central portion; and a fastening for use in removably connecting the diffuser to the support member adjacent the outlet of a heating, ventilating or air conditioning system, the fastening comprising a head and a shank formed integrally with the head, the shank being formed with a screw thread at least adjacent its free end, the fastening being formed integrally with resilient means for retaining the fastening in position on part of the diffuser whilst permitting rotation of the fastening to enable the threaded part of the shank to be engaged with and removed from a bore formed in part of the support member.

* * * * *

UNITED STATES PATENT AND TRADEMARK OFFICE

CERTIFICATE OF CORRECTION

PATENT NO. : 5,411,438

DATED : May 2, 1995

INVENTOR(S) : David White, Colin Sawyer and Pater Bartingale

It is certified that error appears in the above-indentified patent and that said Letters Patent is hereby corrected as shown below:

Title page, after '[75] Inventors:', "Maldstone" should read --Maidstone--.

Column 13 Line 27 "course" should read --coarse--.

Column 14 Line 21 "diffuser." should read --diffusers.--.

Column 14 Line 46 "diffuser" should read --diffusers--.

Column 14 Line 67 "appreciate" should read --appreciated--.

Claim 9 Lines 27-28 Column 16 "protection" should read --projection--.

Claim 12 Line 62 Column 16 after "bores" delete ",".

Signed and Sealed this

Fifth Day of December, 1995

*Attest:*

*Attesting Officer*

Bruce Lehman

BRUCE LEHMAN

*Commissioner of Patents and Trademarks*